US005851962A

United States Patent [19]

Kaga

[11] Patent Number: 5,851,962

[45] Date of Patent: Dec. 22, 1998

[54] LUBRICANT COMPOSITION FOR WET CLUTCH OR WET BRAKE

[75] Inventor: Kuniaki Kaga, Yokkaichi, Japan

[73] Assignee: Ethyl Japan Corporation, Tokyo, Japan

[21] Appl. No.: 879,674

[22] Filed: Jun. 23, 1997

Related U.S. Application Data

[63] Continuation of Ser. No. 211,647, filed as PCT/JP93/01155 Aug. 18, 1993 published as WO94/04637 Mar. 3, 1994, abandoned.

[30] Foreign Application Priority Data

Aug. 18, 1992 [JP] Japan ..... 4-219200

[51] Int. Cl.[6] ..... C10M 129/24; C10M 141/02; C10M 129/08; C10N 40/04

[52] U.S. Cl. ..... 508/162; 508/485; 508/486; 508/487; 508/583

[58] Field of Search ..... 508/162, 164, 508/485, 486, 487, 583

[56] References Cited

U.S. PATENT DOCUMENTS

| | | | |
|---|---|---|---|
| 1,234,862 | 7/1917 | Brown | 252/49 |
| 2,202,128 | 5/1940 | Towne | 508/162 |
| 2,346,356 | 4/1944 | Burk | 252/49 |
| 2,767,111 | 10/1956 | Otto et al. | 508/164 |
| 2,780,597 | 2/1957 | Williams et al. | 508/162 |
| 3,012,967 | 12/1961 | Leonardi et al. | 508/162 |
| 3,026,262 | 3/1962 | Foster et al. | 508/162 |
| 3,150,087 | 9/1964 | Holzinger | 252/25 |
| 3,344,065 | 9/1967 | Gänsheimer et al. | 252/25 |
| 3,652,410 | 3/1972 | Hollinghurst et al. | 252/42.7 |
| 3,912,639 | 10/1975 | Adams | 252/25 |
| 4,178,260 | 12/1979 | Cook et al. | 508/164 |
| 4,675,121 | 6/1987 | Root et al. | 252/25 |
| 4,715,972 | 12/1987 | Pacholke | 252/25 |
| 5,064,546 | 11/1991 | Dasai | 252/32.5 |
| 5,073,277 | 12/1991 | Wirth et al. | 252/32.5 |
| 5,288,792 | 2/1994 | Buxbaum | 252/25 |

FOREIGN PATENT DOCUMENTS

| | | |
|---|---|---|
| 57-51794 | 3/1982 | Japan . |
| 0054298 | 3/1991 | Japan . |
| 4-227690 | 8/1992 | Japan . |
| 5-105895 | 4/1993 | Japan . |

*Primary Examiner*—Margaret Medley
*Attorney, Agent, or Firm*—Dennis H. Rainear; Thomas Hamilton

[57] ABSTRACT

A lubricant composition for a wet clutch or a wet brake is disclosed, which comprises a base oil having added thereto an inorganic phosphorus compound which may contain sulfur atoms and/or oxygen atoms as its constituent elements, or an amine salt thereof, or having added thereto said inorganic phosphoric compound or an amine salt thereof, and an organic polyol compound having at least two hydroxyl groups in one molecule. The composition which exhibits excellent frictional properties in a wet clutch or a wet brake, in particular, provides a high $\mu d$ (dynamic friction coefficient) and a high $\mu s$ (static friction coefficient), shows good prevention of vibration in a lock-up clutch (which is imparted with good durability for preventing such vibration, has friction coefficients free from the temperature dependence, and is effective as a shock absorber oil, a power steering oil, a hydraulic suspension oil, etc.

23 Claims, No Drawings

LUBRICANT COMPOSITION FOR WET CLUTCH OR WET BRAKE

This is a continuation of U.S. patent application Ser. No. 08/211,647, filed Jun. 20, 1994 now abandoned, which is a PCT of JP93/01155 filed Aug. 18, 1993 published as WO94/04637 Mar. 3, 1994.

TECHNICAL FIELD

The present invention relates to a lubricant composition for use in a wet clutch or a wet brake of a power transmission device for an automobile, an agricultural machine, a construction machine, or other industrial machines.

TECHNICAL BACKGROUND

A wet clutch or a wet brake of a power transmission device such as an automatic transmission for an automobile, an agricultural machine, a construction machine, or other industrial machines transmits a driving force by regulating the frictional properties of a plate on the driving side and a plate on the driven side, wherein the frictional properties of a lubricant employed for lubrication have a very important bearing. A wet clutch is taken up for explanation as a representative device in the following description. Since inappropriate frictional properties cause a power transmission loss in the clutch and greatly affect the comfort on operating the machine, it is important for the lubricant to have appropriate frictional properties.

The friction control of a wet clutch of this type involves three friction coefficients, i.e. dynamic friction coefficient, break-away friction coefficient, and static friction coefficient, and it is conventionally required for the regulation of the friction in a wet clutch of this type to raise the power transmission torque (called dynamic friction coefficient and usually expressed as $\mu d$; hereinafter referred to as $\mu d$), and at the same time, to lower the friction transmission torque at the engaging point of the wet clutch (called break-away friction coefficient and usually expressed as $\mu 0$; hereinafter referred to as $\mu 0$). If the ratio of $\mu 0/\mu d$ exceeds 1, a transmission shock is produced to arouse discomfort at the change of speed (when the clutch is operated). If the ratio is 1 or less, no such transmission shock is produced and transmission properties which do not impair comfort are obtained.

The power transmitting capacity of the wet clutch is also of importance, and in this connection, it is usually important to increase the static friction torque (called static friction coefficient and expressed as $\mu s$ to be distinguished from the break-away friction coefficient; hereinafter referred to as $\mu s$).

Since these friction coefficients depend largely upon the lubricant employed, for improving the transmission shock, the use of a friction modifier, etc. has usually been practiced to reduce the ratio of $\mu 0/\mu d$ to 1 or less, however, the addition of the friction modifier, etc. causes at the same time a problem of lowering in $\mu s$. It is, therefore, important in lubricating machines under consideration to obtain a lubricant capable of reducing the $\mu 0/\mu d$ ratio to 1 or less and increasing As as much as possible, thereby eliminating the transmission shock and attaining a high transmitting capacity.

The lubricant is required to show good durability in a long-time use while undergoing little aging change in the friction coefficient and to suppress the transmission shock over a long period of time, however, the addition of a large amount of a friction modifier, etc. to obtain this effect is associated with a problem of lowering in $\mu s$. The $\mu 0/\mu d$ ratio and the $\mu s$ are in a trade-off relation with each other as described heretofore, and accordingly, a variety of designs and inventions have hitherto been made as will be described below.

A lock-up clutch has recently come to be used in an automatic transmission for an automobile to reduce the fuel consumption and to reduce the power loss in a torque converter and thus, the lubricant has been imposed with a still more complicated factor. Specifically, the problem in the lock-up clutch case is a vibration called shudder. The frictional properties at different rotations have an important bearing on the suppression of the vibration and the lubricant composition need be designed to have a ratio of the change in friction coefficient ($\mu$) to the change in slipping velocity (v) at the time when the speed of rotation is changed, i.e., $d\mu/dv \geqq 0$.

The addition of the friction modifier, etc. for achieving $d\mu/dv \geqq 0$, however, usually results in the reduction of static friction coefficient ($\mu s$). Moreover, the vibration is more likely to occur at a relatively low temperature, and therefore, the above-described $d\mu/dv > 0$ need be achieved at a low temperature, however, the friction coefficient is usually so dependent on temperature as to drop along with an elevation in lubricant temperature. Even though the prevention of vibration at a low temperature, for example, 40° C., is achieved by blending a large amount of friction modifier, etc., or by blending a very effective friction modifier with too much care to the prevention of vibration, the friction coefficient in a working temperature range of 80° C. to 120° C. lowers excessively and thereby the torque transmitting capacity in the lock-up clutch decreases, leading to a problem of easy slipping. It is desired, therefore, to free the friction coefficient from the temperature dependence. And also, the durability is required for the suppression of vibration in the lock-up clutch. Accordingly, blending of a large amount of friction modifier, etc. is required in the prior art, which gives rise to the reduction in static friction coefficient ($\mu s$).

The frictional properties are mutually contradictory as stated above, and therefore, a variety of friction modifiers, detergents, phosphoric esters, etc. have hitherto been used. Japanese Patent Application (Laid-Open) No. 173097/1985 (corresponding to Japanese Patent Publication No. 46635/1990), for example, proposes a lubricant composition comprising (A) a phosphoric ester having from 4 to 30 carbon atoms or an amine salt thereof, and (B) one compound selected from the group consisting of a sorbitan fatty acid ester, a glycerol fatty acid ester, a palm kernel oil fatty acid, a coconut oil fatty acid, a compound represented by the general formula $(RCOO)_2Zn$, a mixture of a fat and oil and a fatty acid, and a reaction product of a polyalkylenepolyamine and a fatty acid.

A series of Japanese Patent Application (Laid-Open) Nos. 39395/1991, 39396/1991, 39397/1992, 39398/1991 and 39399/1991 propose the use of a combination of (A) one compound selected from a phosphoric ester, a phosphorous ester, and an amine salt thereof each having from 4 to 30 carbon atoms, and (B) a tertiary amine, an aliphatic dicarboxylic acid, a primary zinc thiophosphate, a succinimide, an overbased magnesium, calcium sulfonate, or the like to improve frictional properties.

All of these techniques employ an amine salt of an organic phosphoric acid having from 4 to 30 carbon atoms to improve the friction behavior.

These conventional lubricant compositions are, however, still unsatisfactory not only in the friction behavior but also in durability and need be more improved. More specifically, in the prior techniques, a very effective compound is used as a friction modifier or a large amount of friction modifier is used to prevent the vibration of a lock-up clutch. The use of such a friction modifier, however, impairs a static friction coefficient ($\mu s$), or the friction control power cannot be maintained by the deterioration or consumption of friction modifier, resulting in the failure to provide satisfactory durability. Moreover, satisfactory performance is not provided with respect to oxidation stability and corrosiveness to copper.

The present invention, accordingly, provides, as a lubricant composition suitable for such a wet clutch, a lubricant composition satisfying such conditions that (1) the $\mu 0/\mu d$ ratio is reduced to eliminate any shock arising from a speed change, (2) the $\mu s$ is increased as high as possible to enhance a torque transmitting property, and (3) the vibration of a lock-up clutch is prevented, while all friction coefficients are free from the temperature dependence.

The present invention also provides a lubricant composition which is excellent in not only initial properties but also durability in view of the prevention of vibration of a lock-up clutch.

DISCLOSURE OF THE INVENTION

The present invention relates to a lubricant composition for a wet clutch or a wet brake comprising a base oil having added thereto an inorganic phosphorus compound which may contain a sulfur atom and/or an oxygen atom as its constituent elements, or an amine salt thereof.

It also relates to a lubricant composition for a wet clutch or a wet brake comprising a base oil having added thereto an inorganic phosphorus compound which may contain sulfur atoms and/or oxygen atoms as its constituent elements, or an amine salt thereof, and an organic polyol compound having at least two hydroxyl groups in one molecule.

The above-described lubricant composition for a wet clutch or a wet brake may further comprise an ashless dispersing agent containing a nitrogen atom.

BEST MODE FOR PRACTICING THE INVENTION

In the lubricant composition for a wet clutch or a wet brake according to the present invention, the base oil used as a principal component of the lubricant composition is not particularly restricted as far as it is a base oil usually employed for a lubricant, and may be a synthetic oil, a mineral oil, or a mixture thereof. The base oil preferably has a kinematic viscosity of 1 to 80 cSt (centisokes), more preferably 2 to 50 cSt, at 100° C. Examples of the mineral oil include a paraffin-based mineral oil, a naphthene-based mineral oil, and a paraffin-naphthene-based mineral oil, and further, a mineral oil dewaxed by a usual method or a mineral oil modified to have a high viscosity index may be used.

Examples of the synthetic lubricant oil include various synthetic oils such as poly-α-olefin, a low-molecular ethylene-α-olefin copolymer, polybutene, a dibasic acid ester, polyglycol, a hindered ester, alkylbenzene, and polyether. A mixed oil of the above-described mineral oil and synthetic oil may also be used.

The inorganic phosphorus compound which may contain an oxygen atom and/or a sulfur atom as its constituent elements includes the followings examples phosphorous acid, phosphoric acid, hypophosphoric acid, phosphorus trioxide, phosphorus tetroxide, phosphorous pentoxide, phosphorotetrathionic acid ($H_3PS_4$), phosphoromonothionic acid ($H_3PO_3S$), phosphorodithionic acid ($H_3PO_2S_2$), phosphorotrithionic acid ($H_3PO_2S_3$), and $P_2S_5$. Among these, phosphorous acid and phosphoric acid are preferred. An amine salt of an inorganic phosphorus compound can also be preferably used. Examples of the amine for use in the amine salt include primary, secondary and tertiary amines, and, in particular, amines containing a tertiary alkyl group, for example, those containing tertiary carbon atoms as carbon atoms adjacent to nitrogen atoms. More specifically, those represented by $R—C(CH_3)_2—NH_2$ (wherein R is an alkyl group having from 16 to 22 carbon atoms), are preferred. It is also possible to use a plurality of these inorganic phosphorus compounds together.

The inorganic phosphorus compound is preferably contained in an amount of from 0.005 wt % to 0.1 wt %, preferably from 0.01 wt % to 0.05 wt %, in terms of the molar amount of phosphorus, based on the total lubricant oil composition, and within this range, the effect of the present invention can be achieved.

Examples of the organic polyol compound having at least two hydroxyl groups in one molecule include 1,2-propanediol, 1,3-propanediol, 1,2-butanediol, 1,3-butanediol, 1,4-butanediol, 1,2-hexanediol, 2,4-hexanediol, 2,4-octanediol, and 1,3-dodecanediol.

A triol, tetraol, or higher alcohol can be used as a simple substance, or as a partially esterified compound of the alcohol, such as a monoester, diester, or triester compound. specifically, when glycerol or trimethylolpropane is used, an ester formed from the triol with a carboxylic acid having from 1 to 40 carbon atoms, preferably with a fatty acid having from 1 to 24 carbon atoms is used. Industrially, the ester is usually a mixture of mono-, di- and triesters, and it is preferred to distill and refine it by molecular distillation, etc. to convert it into a mixture of diester and monoester, or preferably a monoester of higher purity. An ester of a polyhydric alcohol such as tetraol can also be used, and a mixture of di-, tri-, and tetraesters formed with the above-described acids can also be used to leave at least two hydroxyl groups in one molecule. When using a polyhydric alcohol, an alkylaryl group may be used or a carboxylic ester having an alkylaryl group may be formed to increase solubility in the base oil. A polyhydric alcohol having an ester group may be in the form of a thioester. In the polyol containing hydroxyl groups, one of the hydroxyl groups is preferably in the α, β, or γ-position relative to the other hydroxyl group. Two or more of various compounds containing these hydroxyl groups may also be used.

The polyol compound containing at least two hydroxyl groups in one molecule is preferably contained in an amount of from 0.01 wt % to 4 wt %, preferably from 0.1 wt % to 1 wt % based on the total lubricant composition, and within this range, the effects of the present invention can be achieved.

In addition to the above-described essential components, the lubricant composition of the present invention may contain, for the purpose of improving performance as a lubricant, additives usually employed, if desired, such as an antioxidant, a detergent-dispersant, an extreme-pressure agent, a friction modifier, an oiliness improver, an anti-wear agent, a corrosion inhibitor, a rust preventing agent, a rubber swelling agent, a defoaming agent, a pour-point depressant, and a viscosity index improver.

As the antioxidant, a phenol-based antioxidant, an aromatic amine-based antioxidant, a zinc dithiophosphate, etc., is used, and specific examples thereof include 2,6-di-t-butyl-4-methylphenol, 4,4'-methylenebis(2,6-di-t-butylphenol), phenyl-α-naphthylamine, dialkyldiphenylamine, zinc di-2-ethylhexyldithiophosphate, zinc diamyldithiocarbamate, and pinene pentasulfide. The antioxidant is added in an amount of from 0.01 wt % to 2 wt %, preferably from 0. 05 wt % to 1 wt %, based on the lubricant composition.

The detergent-dispersant may be an ashless dispersant, a metallic detergent, or an ashless dispersant containing boron. Specific examples thereof include alkenyl succinimide- and benzylamine-type ashless dispersants, boronized polyisobutenyl succinimide- and boronized benzylamine-type ashless dispersants, metal sulfonate, metal phenate and metal salicylate. The metallic detergent refers to those containing a metal such as magnesium, calcium, or barium. The detergent-dispersant is added in an amount of from 0.01 wt % to 10 wt %, preferably from 0.5 wt % to 5 wt %, based on the lubricant composition.

Examples of the friction modifier include an amine compound such as oleyldiethanolamine, dodecyldiethanolamine, dodecyldipropanolamine, oleylamine, hexadecylamine, dodecyldiethylamine, dodecylethanolamine, and a mixture thereof, an amide such as oleic amide, dodecylcarboxylic acid diethanolamide, dodecylcarboxylic acid propanolamide, oleic acid diethanolamide, oleic acid propanolamide, hexadecylcarboxylic acid diethanolamide, hexadecylcarboxylic acid propanolamide, and a mixture thereof, and N-hydroxyethyl oleylimidazoline.

The above-described additives other than the antioxidant, the detergent-dispersant and the friction modifier are added in such an amount as added for modifying a lubricant for a wet clutch or a wet brake.

The present invention will now be described with reference to Examples. The addition amounts in the Examples are in wt %.

EXAMPLES

The evaluation on performance of the lubricant composition described below is conducted in accordance with the following test method.

(1) SAE No. 2 Friction Tester

Evaluation was conducted by using this tester under the following conditions:

Disk: Paper disk for automatic transmission

Plate: Steel plate for automatic transmission

Motor rotating speed: 3000 rpm

Piston pressure: 40 psi

Lubricant temperature: 120° C.

Measurement was carried out taking the value of 1200 rpm as the dynamic friction coefficient ($\mu d$) and the friction coefficient at the engaging point of the clutch as the breakaway friction coefficient ($\mu 0$) .

The maximum friction coefficient at the engaging point at 0.7 rpm was measured as the static friction coefficient ($\mu s$).

The higher values of $\mu d$ and $\mu s$ were judged the better, and those satisfying $\mu 0/\mu d \leqq 1.1$ were concluded preferable. Those satisfying $\mu 0/\mu d \leqq 1.0$ were more preferred.

The lubricant which underwent aging change in the friction coefficient was not preferred, and for indexing this, the following equation was used with the $\mu s$ at 500 cycles being defined as $\mu s(500)$ and the $\mu s$ at 10,000 cycles being defined as $\mu s(10{,}000)$:

$$\mu s(10{,}000)-\mu s(500)=\Delta\mu s$$

The $\Delta\mu d$ was likewise adopted as for $\mu d$.

The lower $\Delta\mu s$ and $\Delta\mu d$ were accordingly judged the better.

(2) LVFA (Single-Plate Low-Velocity Friction Tester)

The evaluation was conducted on the prevention of vibration of a lock-up clutch by using a single-plate low-velocity friction tester. The relation of the friction coefficient—the slip velocity (hereinafter referred to as $\mu$-v characteristics) at a fixed temperature was obtained.

Disk: Paper disk for automatic transmission (1 disk)

Plate: Steel plate for automatic transmission (1 plate)

Surface pressure: 10 kg/cm$^2$

Lubricant temp.: 40° C., 100° C.

Motor rotating speed:

The rotating speed was intermittently varied in a range of from 1 to 100 rpm.

The rotating speed was varied to determine the friction coefficient ($\mu$) versus the slip velocity (v), and when $d\mu/dv \geqq 0$, the vibration was prevented and performance was judged For the sake of convenience, the friction coefficient at the rotation speed of 1 rpm was defined as $\mu 1$ and the friction coefficient at 50 rpm was defined as $\mu 50$. The $\mu 1/\mu 50$ ratio was employed as the index. The lubricant satisfying $\mu 1/\mu 50 \leqq 1$ was concluded as having a preferred ability of preventing vibration.

In LVFA, the lower the lubricant temperature, the more difficult the prevention of vibration, and the $\mu 1/\mu 50$ ratio as an index of frictional properties is likely to become $\mu 1/\mu 50 \geqq 1$. On the other hand, although $\mu 1/\mu 50 \leqq 1$ is easily achieved in the vicinity of a practical working temperature range of from 80° C. to 120° C., the reduction in the absolute value of $\mu 1$ disadvantageously causes the slipping of the clutch. The value of $\mu$ generally shows the temperature dependence and becomes smaller as the temperature is elevated, and a lubricant free of the temperature dependence is demanded. Therefore, the ratio of $\mu 1$(40° C.)/$\mu 1$(100° C.)=$\mu 1$(T) was employed as the index showing the temperature dependence, by taking the friction coefficient at 1 rpm and 40° C. as $\mu 1$(40° C.), and the friction coefficient at 1 rpm and 100° C. as $\mu 1$(100° C.), with the value of $\mu 1$(T) close to 1 being concluded as good.

For evaluating the durability on the prevention of vibration, the evaluation of $\mu$-v characteristics was conducted in the LVFA for the tested lubricant after 10,000 cycles in the SAE No. 2 friction test using a new disk and a new plate. The $\mu 1/\mu 50$ ratio of the new lubricant and the $\mu 1/\mu 50$ ratio of the used lubricant were compared and the lubricant which showed little difference in the ratio value was concluded as having good durability.

(3) Oxidation Stability Test:

The test was conducted at 165.50° C. for 120 hours in accordance with the oxidation stability test of a lubricant for an internal combustion engine (JIS K-2514).

(4) Copper Corrosion Test:

The amount of copper eluted after the processing at 150° C. for 16 hours in accordance with JIS K-2513 was measured and the evaluation was made for judging the corrosion thereafter.

EXAMPLES 1, 2 AND COMPARATIVE EXAMPLES 1 TO 6

Samples each having the following composition were prepared by further adding thereto, in addition to the additives set forth below and additives described in respective tables, a paraffin-based mineral oil having a kinematic viscosity of 4.2 cSt at 100° C. as the rest to make up 100 wt % in total. An amount of athe phosphorus compound was added so that the molar amounts of the phosphorus in the compositions became equal, and the, above-described evaluation was conducted. The evaluation results are shown in Table 1 and Table 2. In Tables 1–4, the overall characteristics as a lubricant composition are expressed by ⊙ as excellent, ○ as good, Δ as acceptable, and × as unacceptable.

| Formulation of Lubricant Composition | (wt %) |
|---|---|
| Polybutenyl succinimide (HiTEC 4728: produced by Ethyl Petroleum Additives Inc.) | 4.0 |
| Phenol-based antioxidant (HiTEC 4728: produced by Ethyl Petroleum Additives Inc.) | 0.5 |
| N-Hydroxyethyl oleylimidazoline | 0.02 |
| Hydroxyethyl long-chained amine (Ethomeen T-12: produced by Akzo Chem. Inc.) | 0.1 |
| Sulfurized fats and oils (Sulperm 10S: produced by Keil Products Division of Ferro Corporation) | 0.5 |
| Tolyltriazole | 0.04 |
| Caprylic acid | 0.05 |
| Calcium phenate (Oloa 216: produced by Chevron Chemical Co.) | 0.05 |
| Silicone-based defoaming agent (added in amount corresponding to 8 ppm of silicon in the test oil) | |
| Acrylate copolymer (PC-1244: produced by Monsanto Co.) | 0.02 |
| Dispersion-type polymethacrylate | 6.0 |
| Compounds shown in each Table | amounts shown in each table |
| Paraffin-based mineral oil (kinematic viscosity at 100° C.: 4.2 cSt) | the rest (100 in total) |

In Examples, orthophosphorous acid was used as an inorganic phosphorus compound and monolauryl glyceride as a polyol.

TABLE 1

| | Comparative Example | | | | | | Example | |
|---|---|---|---|---|---|---|---|---|
| Additives | 1 | 2 | 3 | 4 | 5 | 6 | 1 | 2 |
| Octyl acid phosphate | 0.30 | 0.30 | | | | | | |
| Dioctylhydrodiene phosphite | | | 0.35 | 0.35 | | | | |
| Amine salt of octyl acid phosphate | | | | | 0.90 | 0.90 | | |
| Inorganic phosphorus acid | | | | | | | 0.10 | 0.10 |
| Monolauryl glyceride | 0.50 | | 0.50 | | 0.50 | | 0.50 | |
| Other additives + base oil | 99.20 | 99.70 | 99.15 | 99.65 | 98.60 | 99.10 | 99.40 | 99.90 |
| Results of SAE NO. 2 test | | | | | | | | |
| $\mu 0$ | 0.137 | 0.140 | 0.151 | 0.154 | 0.139 | 0.145 | 0.146 | 0.147 |
| $\mu d$ | 0.123 | 0.124 | 0.130 | 0.129 | 0.119 | 0.120 | 0.143 | 0.143 |
| $\mu s$ | 0.116 | 0.117 | 0.117 | 0.118 | 0.120 | 0.120 | 0.125 | 0.127 |
| $\mu 0/\mu d$ | 1.11 | 1.13 | 1.16 | 1.19 | 1.17 | 1.21 | 1.02 | 1.03 |
| $\Delta\mu d$ | 0.007 | 0.009 | 0.015 | 0.016 | 0.004 | 0.005 | 0.004 | 0.005 |
| $\Delta\mu s$ | 0.011 | 0.014 | 0.025 | 0.024 | 0.012 | 0.014 | 0.000 | 0.001 |
| Overall Judgment | x | x | x | x | x | x | ⊙ | ⊙ |

TABLE 2

| LVFA | Comparative Example | | | | | | Example | |
|---|---|---|---|---|---|---|---|---|
| Test Results | 1 | 2 | 3 | 4 | 5 | 6 | 1 | 2 |
| Fresh Oil | | | | | | | | |
| $\mu 1$ | 0.115 | 0.120 | 0.116 | 0.123 | 0.117 | 0.119 | 0.125 | 0.127 |
| $\mu 50$ | 0.140 | 0.138 | 0.141 | 0.138 | 0.140 | 0.139 | 0.140 | 0.139 |
| $\mu 1/\mu 50$ | 0.82 | 0.87 | 0.82 | 0.89 | 0.84 | 0.86 | 0.89 | 0.91 |
| $\mu 1(T)$ | 1.10 | 1.12 | 1.10 | 1.13 | 1.08 | 1.13 | 1.01 | 1.08 |

TABLE 2-continued

| LVFA | Comparative Example | | | | | | Example | |
|---|---|---|---|---|---|---|---|---|
| Test Results | 1 | 2 | 3 | 4 | 5 | 6 | 1 | 2 |
| Overall judgment | Δ | x | Δ | x | Δ | x | ⊙ | Δ |
| Used Oil | | | | | | | | |
| $\mu 1$ | 0.125 | 0.165 | 0.119 | 0.168 | 0.120 | 0.164 | 0.126 | 0.165 |
| $\mu 50$ | 0.144 | 0.137 | 0.140 | 0.138 | 0.140 | 0.137 | 0.140 | 0.139 |
| $\mu 1/\mu 50$ | 0.87 | 1.20 | 0.85 | 1.22 | 0.86 | 1.20 | 0.90 | 1.19 |
| $\mu 1(T)$ | 1.09 | 1.25 | 1.08 | 1.21 | 1.09 | 1.20 | 0.99 | 1.21 |
| Overall judgment | Δ | x | Δ | x | Δ | x | ⊙ | x |

As is apparent from comparison of Example 1 with Comparative Examples 1, 3 and 5, the samples containing the inorganic phosphorus compound show high $\mu d$ and $\mu s$, the lowest $\mu 0/\mu d$ ratio, and low $\Delta\mu s$ and $\Delta\mu d$ indicating the aging change of the friction coefficient, Example 1 to be best. Other samples show high $\mu 0/\mu d$ ratio and also high $\Delta\mu s$ and $\Delta\mu d$, revealing them to be bad.

The effect of monolauryl glyceride as a polyol is confirmed by the evaluation in LVFA of the lubricants used in the SAE No. 2 friction test. That is, without monolauryl glyceride, the $\mu 1/\mu 50$ ratio exceeds 1, and the temperature dependence appears as seen from $\mu 1(T)$.

In conclusion, it is found that, when the inorganic phosphorus compound and monolauryl glyceride are present together, ideal frictional properties are obtained such as high $\mu d$ and $\mu s$ and a low $\mu 0/\mu d$ ratio in the SAE NO. 2 frictional properties, and $\mu 1/\mu 50$ below 1 and $\mu 1(T)$ closest to 1 in the $\mu$-v characteristics by LVFA for the used oil.

EXAMPLES 3, 4 AND COMPARATIVE EXAMPLE 7 TO 10

Lubricant compositions were prepared in the same manner as the lubricant compositions in Examples 1 and 2 and Comparative Examples 1 to 6, except for adding 0.1 wt % of boric acid.

The composition of each sample is shown in Table 3, and the evaluation as a lubricant composition was conducted in the same manner as above, which results are shown in Tables 3 and 4.

TABLE 3

| Additives | Comparative Example 7 | 8 | 9 | 10 | Example 3 | 4 |
|---|---|---|---|---|---|---|
| Octyl acid phosphate | 0.30 | 0.30 | | | | |
| Amine salt of octyl acid phosphate | | | 0.90 | 0.90 | | |
| Inorganic phosphorus acid | | | | | 0.10 | 0.10 |
| Monolauryl glyceride | 0.50 | | 0.50 | | 0.50 | |
| Other additives + base oil | 99.20 | 99.70 | 98.60 | 99.10 | 99.40 | 99.90 |
| Results of SAE NO. 2 test | | | | | | |
| $\mu 0$ | 0.137 | 0.140 | 0.134 | 0.136 | 0.147 | 0.146 |
| $\mu d$ | 0.123 | 0.122 | 0.121 | 0.120 | 0.142 | 0.141 |
| $\mu s$ | 0.116 | 0.115 | 0.113 | 0.115 | 0.122 | 0.123 |
| $\mu 0/\mu d$ | 1.11 | 1.15 | 1.11 | 1.13 | 1.04 | 1.04 |
| $\Delta \mu d$ | 0.007 | 0.010 | 0.008 | 0.007 | 0.005 | 0.009 |

TABLE 3-continued

| Additives | Comparative Example 7 | 8 | 9 | 10 | Example 3 | 4 |
|---|---|---|---|---|---|---|
| $\Delta \mu s$ | 0.011 | 0.013 | 0.009 | 0.012 | 0.001 | 0.001 |
| Overall Judgment | x | x | x | x | ◎ | ◎ |

TABLE 4

| LVFA Test Results | | Comparative Example 7 | 8 | 9 | 10 | Example 3 | 4 |
|---|---|---|---|---|---|---|---|
| Fresh Oil | $\mu 1$ | 0.120 | 0.121 | 0.124 | 0.123 | 0.119 | 0.135 |
| | $\mu 50$ | 0.145 | 0.140 | 0.144 | 0.143 | 0.143 | 0.147 |
| | $\mu 1/\mu 50$ | 0.83 | 0.86 | 0.86 | 0.86 | 0.83 | 0.92 |
| | $\mu 1(T)$ | 1.11 | 1.14 | 1.15 | 1.14 | 0.96 | 1.07 |
| | Overall judgment | Δ | x | Δ | x | ◎ | Δ |
| Used Oil | $\mu 1$ | 0.123 | 0.165 | 0.118 | 0.160 | 0.123 | 0.161 |
| | $\mu 50$ | 0.142 | 0.137 | 0.140 | 0.137 | 0.140 | 0.148 |
| | $\mu 1/\mu 50$ | 0.87 | 1.20 | 0.84 | 1.17 | 0.88 | 1.09 |
| | $\mu 1(T)$ | 1.10 | 1.25 | 1.09 | 1.19 | 1.00 | 1.19 |
| | Overall judgment | Δ | x | Δ | x | ◎ | x |

As is apparent from comparison between Examples 3 and 4 and Comparative Examples 7 to 10, when the inorganic phosphorus compound and monolauryl glyceride are present together as in Example 3, the samples satisfying both the frictional properties in SAE No. 2 test and the durability and temperature dependence in LVFA test are obtained.

EXAMPLES 5 TO 10 AND COMPARATIVE EXAMPLES 11 TO 13

Lubricant compositions were prepared in the same manner as the lubricant compositions in Examples 3 and 4 and Comparative Examples 7 to 10 above, except for changing the friction modifier to an amine-type friction modifier and the polyol compound variously. The composition of each lubricant composition is shown in Table 5, and the results are shown in Tables 5 and 6.

TABLE 5

| Additives | Comparative Example 11 | 12 | 13 | Example 5 | 6 | 7 | 8 | 9 | 10 |
|---|---|---|---|---|---|---|---|---|---|
| Inorganic phosphorus compound | 0.10 | 0.10 | 0.10 | 0.10 | 0.10 | 0.10 | 0.10 | 0.10 | 0.10 |
| Amine-type friction modifier | 0.20 | 0.40 | 0.60 | | | | | | |
| 1,3-Butanediol | | | | 0.20 | | | | | |
| 2,4-Hexanediol | | | | | 0.50 | | | | |
| Monobutyl glyceride | | | | | | 0.50 | | | |
| Monolauryl glyceride | | | | | | | 0.50 | | |
| Monooleyl glyceride | | | | | | | | 0.50 | |
| Dioleyl pentaerythritol ester | | | | | | | | | 0.50 |
| Other additives + base oil | 99.70 | 99.50 | 99.30 | 99.70 | 99.40 | 99.40 | 99.40 | 99.40 | 99.40 |
| Results of SAE NO. 2 test | | | | | | | | | |
| $\mu 0$ | 0.153 | 0.148 | 0.146 | 0.153 | 0.155 | 0.160 | 0.152 | 0.151 | 0.152 |
| $\mu d$ | 0.140 | 0.141 | 0.140 | 0.146 | 0.147 | 0.149 | 0.146 | 0.145 | 0.144 |
| $\mu s$ | 0.120 | 0.112 | 0.105 | 0.129 | 0.130 | 0.130 | 0.126 | 0.127 | 0.124 |
| $\mu 0/\mu d$ | 1.09 | 1.05 | 1.04 | 1.05 | 1.05 | 1.07 | 1.04 | 1.04 | 1.06 |

TABLE 6

| LVFA Test Results | Comparative Example 11 | 12 | 13 | Example 5 | 6 | 7 | 8 | 9 | 10 |
|---|---|---|---|---|---|---|---|---|---|
| Fresh Oil | | | | | | | | | |
| $\mu 1$ | 0.124 | 0.118 | 0.112 | 0.128 | 0.132 | 0.130 | 0.124 | 0.126 | 0.128 |
| $\mu 50$ | 0.140 | 0.139 | 0.139 | 0.145 | 0.144 | 0.145 | 0.143 | 0.140 | 0.148 |
| $\mu 1/\mu 50$ | 0.89 | 0.85 | 0.81 | 0.88 | 0.92 | 0.90 | 0.87 | 0.90 | 0.86 |
| $\mu 1(T)$ | 1.10 | 1.15 | 1.17 | 0.99 | 0.99 | 0.98 | 0.96 | 1.02 | 1.05 |
| Used Oil | | | | | | | | | |
| $\mu 1$ | 0.164 | 0.161 | 0.155 | 0.129 | 0.134 | 0.131 | 0.124 | 0.127 | 0.143 |
| $\mu 50$ | 0.148 | 0.149 | 0.150 | 0.143 | 0.145 | 0.144 | 0.142 | 0.141 | 0.150 |
| $\mu 1/\mu 50$ | 1.11 | 1.08 | 1.03 | 0.90 | 0.92 | 0.91 | 0.87 | 0.90 | 0.95 |
| $\mu 1(T)$ | 1.15 | 1.18 | 1.19 | 1.01 | 0.99 | 1.00 | 1.02 | 0.99 | 1.11 |

As is apparent from Comparative Examples 11 to 13, although the $\mu 0/\mu d$ ratio is improved by increasing the addition amount of the amine-type friction modifier, the As lowers as the addition amount increases, which is disadvantageous. Also, in the $\mu$-v characteristics by LVFA, the $\mu 1/\mu 50$ ratio is improved as the addition amount increases, but the absolute value of $\mu 1$ decreases and the value of $\mu 1(T)$ becomes larger, which is disadvantageous. In other words, when the amount of ordinary friction modifier is increased to prevent vibration in the lock-up clutch, the prevention of vibration can be achieved but the $\mu s$ indicating a torque transmitting capacity lowers and also the value of $\mu 1$ in a high lubricant temperature range decreases in the case of a lock-up clutch due to the temperature dependence, accompanied with the slipping of the clutch, which is disadvantageous.

On the other hand, as is apparent from Examples 5 to 10, the samples containing an inorganic phosphorus compound of the present invention and 2,4-hexanediol, 2,4-octanediol, monobutyl glyceride, monolauryl glyceride, or dioleylpentaerythritol ester show a low $\mu 0/\mu d$ ratio, while maintaining a high As. Moreover, the $\mu 1/\mu 50$ ratio in LVFA of the lubricant used in the SAE NO. 2 friction test is low and no temperature dependence appears.

EXAMPLES 11, 12 AND COMPARATIVE EXAMPLES 14 TO 17

The lubricant compositions shown in Table 3 were compared in respect of oxidation stability by the Oxidation Stability Test. The composition of each sample and the results are shown in Table 7 below.

TABLE 7

| | Comparative Example | | | | Example | |
|---|---|---|---|---|---|---|
| Additives | 14 | 15 | 16 | 17 | 11 | 12 |
| Octyl acid phosphate | 0.30 | 0.30 | | | | |
| Amine salt of octyl acid phosphate | | | 0.90 | 0.90 | | |
| Inorganic phosphorus acid | | | | | 0.10 | 0.10 |
| Monolauryl glyceride | 0.50 | | 0.50 | | 0.50 | |
| Other additives + base oil | 99.20 | 99.70 | 98.60 | 99.10 | 99.40 | 99.90 |
| Test results | | | | | | |
| Increase in viscosity at 40° C. % | 60 | 63 | 54 | 51 | 12 | 10 |
| TAN Increase | 5.6 | 5.4 | 5.3 | 5.5 | 1.0 | 1.1 |
| Extinction coefficient of carbonyl | 0.39 | 0.40 | 0.41 | 0.42 | 0.18 | 0.18 |
| Undissolved B % | 0.01 | 0.01 | 0.01 | 0.01 | 0.01 | 0.01 |
| Eluted copper (ppm) | 132 | 125 | 113 | 128 | 38 | 40 |

As is apparent from the Table, when the inorganic phosphorus compound is added, the oxidation stability is good with a small increase in kinematic viscosity and total acid number. The less the eluted copper amount, the better, and samples containing the phosphorus compound showed good results.

EXAMPLES 13, 14 AND COMPARATIVE EXAMPLES 18 TO 21

The same lubricant compositions as in Examples 11 and 12 and Comparative Examples 14 to 17 were subjected to a corrosion test of copper plates.

The composition of each lubricant composition and the test results are shown in Table 8 below.

TABLE 8

| | Comparative Example | | | | Example | |
|---|---|---|---|---|---|---|
| Additives | 18 | 19 | 20 | 21 | 13 | 14 |
| Octyl acid phosphate | 0.30 | 0.30 | | | | |
| Amine salt of octyl acid phosphate | | | 0.90 | 0.90 | | |

TABLE 8-continued

| | Comparative Example | | | | Example | |
|---|---|---|---|---|---|---|
| Additives | 18 | 19 | 20 | 21 | 13 | 14 |
| Inorganic phosphorus acid | | | | | 0.10 | 0.10 |
| Monolauryl glyceride | 0.50 | | 0.50 | | 0.50 | |
| Other additives + base oil | 99.20 | 99.70 | 98.60 | 99.10 | 99.40 | 99.90 |
| Test results | | | | | | |
| Eluted copper (ppm) | 115 | 130 | 136 | 129 | 14 | 12 |

Also in the corrosion test of copper plates, the eluted amount of copper is small when the inorganic phosphorus compound is added, revealing the superiority of the addition.

POSSIBILITY OF UTILIZATION IN INDUSTRY

The lubricant composition of the present invention exhibits excellent frictional properties in a wet clutch and a wet brake, in particular, provides a high $\mu d$ (dynamic friction coefficient) and a high $\mu s$ (static friction coefficient), shows good prevention of vibration in a lock-up clutch used for an automatic transmission, is imparted with good durability for preventing the vibration, thus showing excellent properties as a lubricant composition for a wet clutch or a wet brake, further, has friction coefficients free from the temperature dependence, and works sufficiently effectively as a shock absorber oil, a power steering oil, a hydraulic suspension oil, etc.

I claim:

1. A lubricant oil composition for a wet clutch or a wet brake lubricant comprising a base oil having added thereto (i) from 0.005 wt % to 0.1 wt % of an inorganic phosphorus compound selected from the group consisting of phosphoric acid and phosphorous acid or an amine salt thereof, and (ii) from 0.01 wt % to 4 wt % of at least one member selected from the group consisting of an organic polyol compound having at least two hydroxyl groups in the molecule and a partially-esterified organic polyol compound having at least two hydroxyl gr oups in the molecule.

2. A lubricant composition for a wet clutch or a wet brake according to or claim 1, which further contains an ashless dispersant containing nitrogen atoms.

3. A composition according to claim 1 wherein said inorganic phosphorus compound is phosphorous acid or an amine salt thereof.

4. A composition according to claim 3 wherein the polyol is a diol.

5. A composition according to claim 4 wherein one of the hydroxyl groups in said diol is in the α, β, or γ-position relative to the other hydroxyl group.

6. A composition according to claim 5 wherein said diol is selected from the group consisting of 1,2-propanediol, 1,3-propane-diol,- 1,2-butanediol, 1,3-butanediol, 1,4-butanediol, 1,2-hexane-diol, 2,4-hexanediol, 2,4-octanediol, and 1,3-dodecanediol.

7. A composition according to claim 3 wherein (ii) is a partially-esterified organic polyol.

8. A composition according to claim 7 wherein one of the hydroxyl groups in said monoester, diester or triester of said polyol is in the α, β, or γ-position relative to the other hydroxyl group.

9. A composition according to claim 7 wherein the partially-esterified organism polyol, consists essentially of a monoester of glycerol or trimethylol-propane with a carboxylic acid having from 1 to 40 carbon atoms.

10. A composition according to claim 9 wherein the monoester is selected from the group consisting of monobutyl glyceride, mono-lauryl glyceride and monooleyl glyceride.

11. A composition according to claim 7 wherein partially-esterified organism polyol consists essentially of dioleyl pentaerythritol ester.

12. A composition according to claim 1 wherein the inorganic phosphorus compound is phosphorous acid, wherein component (ii) consists essentially of a diol in which one of the hydroxyl groups is, in the α, β, or γ-position relative to the other hydroxyl group, and wherein said composition further contains an ashless dispersant containing nitrogen atoms.

13. A composition according to claim 12 wherein said diol is selected from the group consisting of 1,2-propanediol, 1,3-propanediol, 1,2-butanediol, 1,3-butanediol, 1,4-butanediol, 1,2-hexanediol, 2,4-hexanediol, 2,4-octanediol, and 1,3-dodecane-diol.

14. A composition according to claim 1 wherein component (ii) is a monoester of glycerol or trimethylolpropane with a carboxylic acid having from 1 to 40 carbon atoms.

15. A composition according to claim 14 wherein said monoester is monolauryl glyceride.

16. A composition according to claim 14 wherein said monoester is monooleyl glyceride.

17. A composition according to claim 14 wherein said monoester is monobutyl glyceride.

18. A lubricating oil composition that is formulated for use as a wet clutch or a wet brake lubricant, and that comprises a base oil having a kinematic viscosity of 2 to 50 cSt at 100° C. having added thereto (i) from 0.01 wt % to 0.05 wt % of phosphorus as at least one inorganic phosphorus compound selected from the group consisting of phosphorous acid and phosphoric acid, and amine salts thereof; and (ii) from 0.01 wt % to 4 wt % of at least one member selected from the group consisting of an organic polyol having at least two hydroxyl groups per molecule and a partially-esterified organic polyol compound having at least two hydroxyl groups in the molecule, the foregoing percentages being based on the total weight of said composition.

19. A composition according to claim 18 wherein the inorganic phosphorus compound added to said composition is phosphorous acid.

20. A composition according to claim 18 wherein said composition further contains an ashless dispersant containing nitrogen atoms.

21. A composition according to claim 20 wherein the inorganic phosphorus compound added to said composition is phosphorous acid, and wherein component (ii) is a partially-esterified organic polyol.

22. A composition according to claim 18 wherein in the SAE No. 2 Friction test conducted as herein described, $\mu 0$ is at least 0.146, $\mu d$ is at least 0.141, $\mu s$ is at least 0.122, and the $\mu 0/\mu d$ ratio is equal to or less than 1.1.

23. A composition according to claim 22 wherein the inorganic phosphorus compound added to said composition is phosphorous acid, and wherein component (ii) is a partially-esterified organic polyol, and wherein said composition further contains an ashless dispersant containing nitrogen atoms.

* * * * *